US006371802B1

(12) United States Patent
Smalley, Jr. et al.

(10) Patent No.: US 6,371,802 B1
(45) Date of Patent: Apr. 16, 2002

(54) HEADER CONNECTOR WITH STABILIZER

(75) Inventors: Jared Smalley, Jr., Harrisburg, PA (US); Eric Juntwait, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/717,571

(22) Filed: Nov. 21, 2000

(51) Int. Cl.[7] ..... H01R 13/73
(52) U.S. Cl. ..... 439/567
(58) Field of Search ..... 439/567, 571–572, 439/569, 570, 78

(56) References Cited

U.S. PATENT DOCUMENTS 4,575,176 A * 3/1986 Castello et al.
4,900,276 A * 2/1990 Doutrich ..... 439/751
5,230,638 A * 7/1993 DiViesti ..... 439/567
5,529,514 A * 6/1996 Gargiulo ..... 439/567
5,980,314 A * 11/1999 Roberts ..... 439/567
6,162,091 A * 12/2000 Kurotori et al. ..... 439/567

* cited by examiner

*Primary Examiner*—Gary Paumen
(74) *Attorney, Agent, or Firm*—Wei Te Chung

(57) ABSTRACT

A pin header (10) for being mounted onto a printed circuit board (30) includes a dielectric housing (12) and a single row of terminal pins (14) in the housing. The housing forms a pair of boardlocks (16) and a stabilizer bar (18) on a same lateral side (122) thereof. Each boardlock forms a pair of legs (162) for being interferingly inserted into a hole (34) in the printed circuit board for preventing the housing from floating during soldering or rocking toward a second lateral side (123) of the housing opposite the lateral side (122). The stabilizer bar has a bottom surface (182) generally co-planar with a bottom face (124) of the housing for abutting on a top surface (36) of the printed circuit board, for preventing the housing from leaning toward the lateral side. Therefore, the terminal pins can be correctly soldered into first holes (32) of the printed circuit board since the header is stabilized by the boardlock and the stabilizer bar.

2 Claims, 4 Drawing Sheets

HEADER CONNECTOR WITH STABILIZER

BACKGROUND OF THE INVENTION

1. Field of the Invention

The present invention relates to a header connector for fixing to a printed circuit board and, more particularly, to a header connector with stabilizing means for holding the header connector vertical while its terminal pins are soldering to the printed circuit board.

2. Description of the Prior Art

Since the advent of the printed circuit board, electrical components have generally been fixed to boards by soldering the component leads to a printed electrical pattern on the board. Often times, component leads extend through holes which have been defined in the board and are soldered into the holes.

One of the problems commonly encountered in soldering operations is maintaining the components in the desired position or orientation during assembly and soldering. Various attempts have been made to solve this problem, especially for header connectors having a single row of terminal pins. The problem with such header connectors is they have a relatively small base area and tend to rock to the side thereof if they have no reliable stabilizing means. Such header connectors are disclosed in U.S. Pat. Nos. 4,900,276 and 4,575,176.

Referring to FIG. 5, U.S. Pat. No. 4,900,276 discloses a pin header 1 for soldering to a printed circuit board 17. Said pin header 1 comprises a dielectric housing 15 and a single row of terminal pins held in the housing 15. The terminal pins include a pair of crimped terminal pins 12A and 12B forming insertion ends 13A and 13B, respectively, for insertion into respective holes 16 defined in the board 17. Said insertion ends 13A and 13B comprise crimped portions 19A and 19B, respectively, for abutting against hole surfaces to provide necessary retention force during the soldering operation of the plurality of terminal pins. However, the terminal ends 13A, 13B are flat and thin, and they tend to float under high temperature during soldering or assembly, resulting in an insufficient retention force being provide between the terminal pins of the header 1 and the board 17.

Hence, a pin header with an improved stabilizer is required to overcome the disadvantages of the prior art.

BRIEF SUMMARY OF THE INVENTION

A main object of the present invention is to provide a header connector having stabilizing means for preventing the header from rocking or floating during a soldering process attaching the header to a printed circuit board.

A header connector in accordance with the present invention is adapted for being mounted onto a printed circuit board. The header includes a dielectric housing and a single row of terminal pins held in the housing. Each terminal pin forms a contact portion for contacting a terminal of a mating connector and a tail portion for vertically soldering into a first hole defined in the board. The contact portion and the tail portion project beyond the top and bottom faces of the housing, respectively. The housing forms at least one boardlock and a stabilizer bar on a lateral side thereof. The boardlock forms a pair of legs for being interferingly inserted into a second hole defined in the printed circuit board. Each leg forms a barb at a tip end thereof for abutting against a bottom surface of the board for preventing the housing from rocking toward a side opposite the lateral side of the housing. The stabilizer bar has a bottom surface abutting against a top surface of the board for preventing the housing from rocking toward the lateral side of the housing. Therefore, the housing is securely stabilized on the printed circuit board, allowing the terminal pins to be correctly soldered to the printed circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
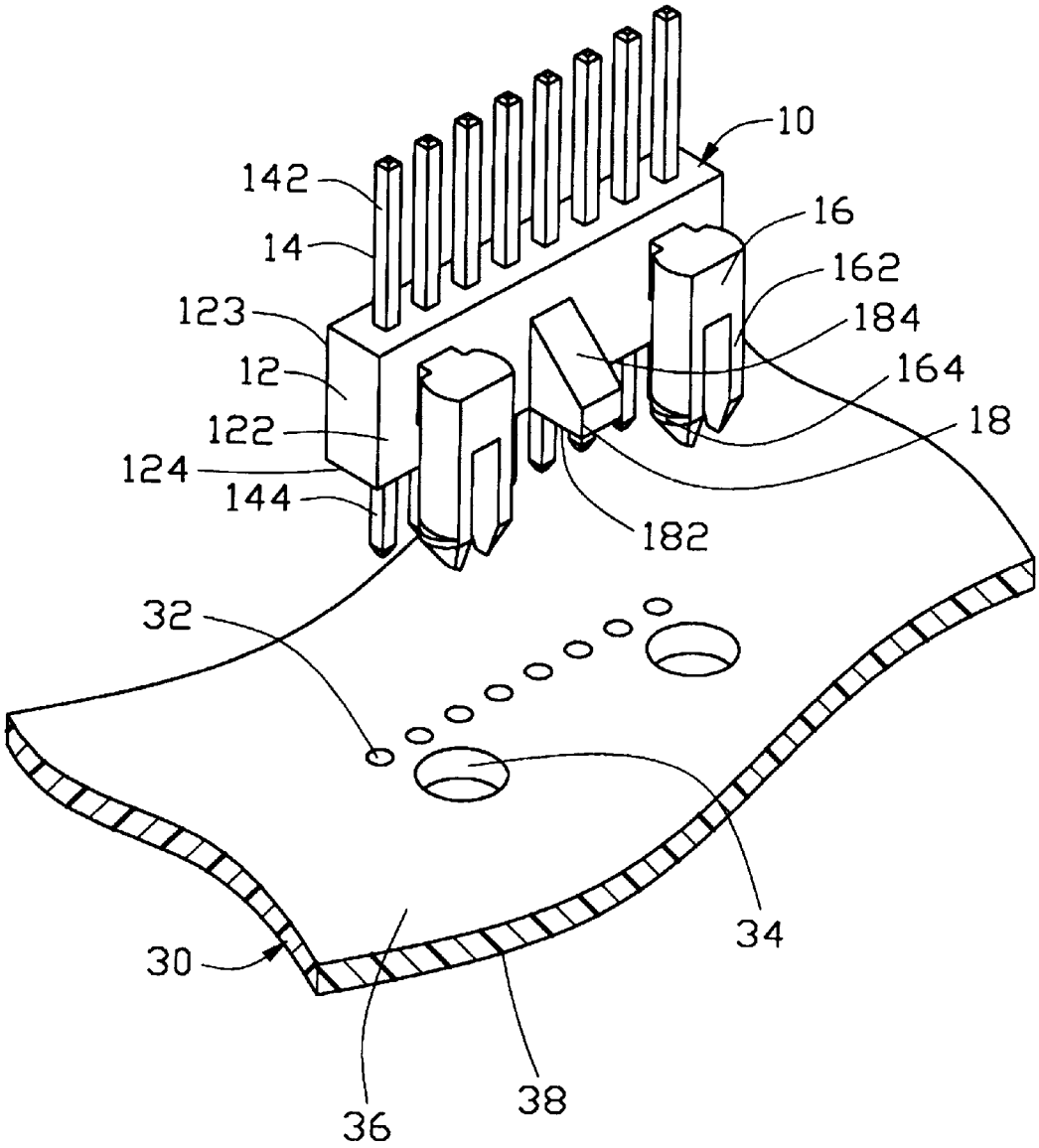
FIG. 1 is a perspective view of a header in accordance with the present invention and a printed circuit board.
Figure 2:
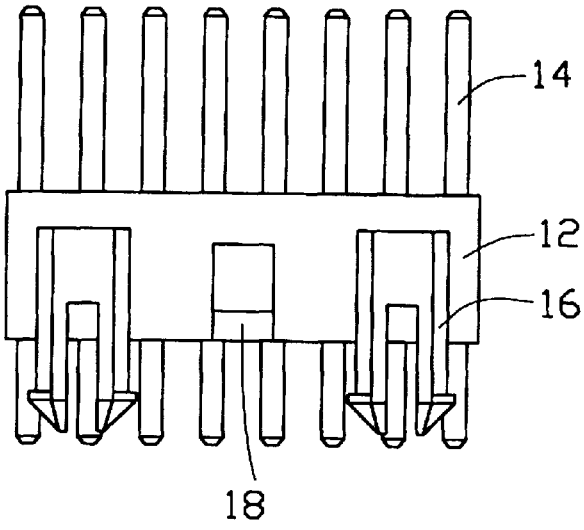
FIG. 2 is a front planar view of the header of FIG. 1.
Figure 3:
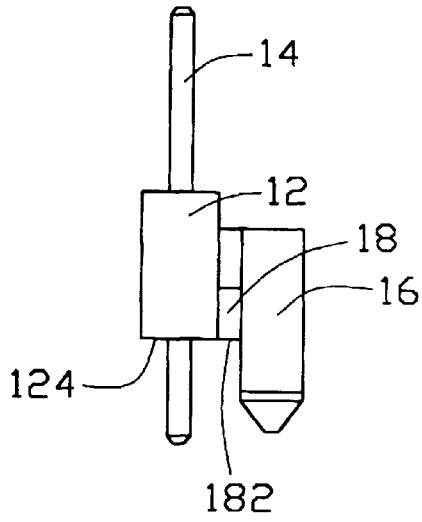
FIG. 3 is a side planar view of the header of FIG. 1.
Figure 4:
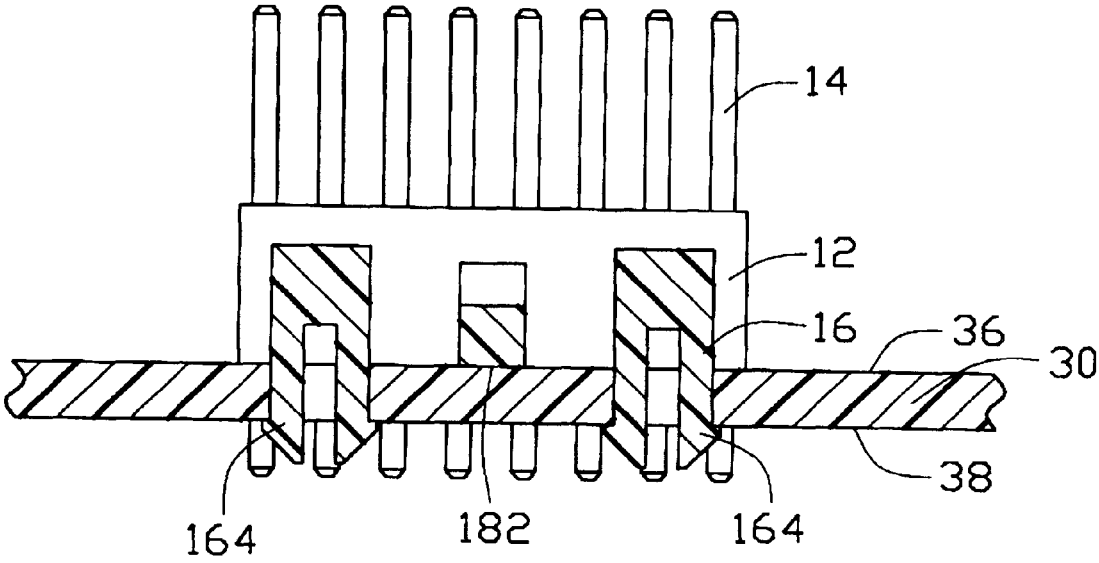
FIG. 4 is a cross-sectional view of the header completely mounted onto the printed circuit board of FIG. 1.
Figure 5:
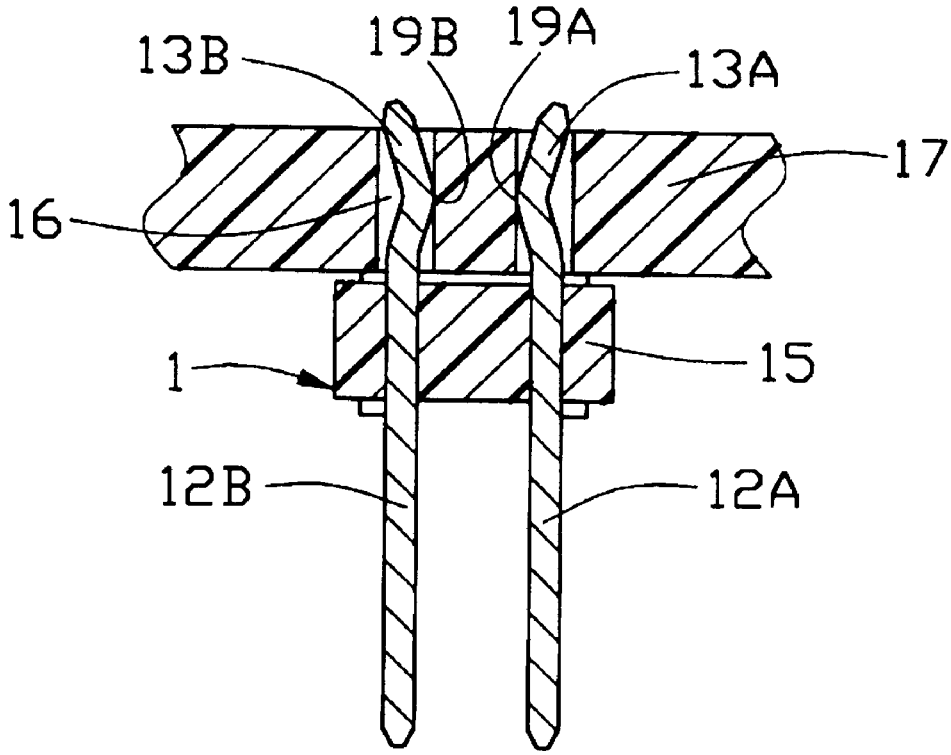
FIG. 5 (PRIOR ART)
FIG. 5 is partial cross sectional view of a prior art header connector assembled to a printed circuit board.

Referring to FIGS. 1 to 3, an electrical connector, commonly termed a pin header 10, in accordance with the present invention is adapted for mounting onto a printed circuit board 30. The header 10 comprises a dielectric housing 12 and a plurality of square terminal pins 14 held in the housing 12.

Each terminal pin 14 comprises a contact portion 142 and a tail portion 144 projecting beyond top and bottom surfaces of the housing 12, respectively. The contact portion 142 is adapted for mating with a terminal of a female connector (not shown) which is electrically connected with a ribbon cable (not shown). The tail portion 144 is adapted for vertically inserting into a corresponding first hole 32 defined in the board 30 and being soldered therein, thereby electrically connecting the ribbon cable to the board 30.

The dielectric housing 12 has a rectangular shape and forms a pair of boardlocks 16 on one of the lateral sides 122 thereof. Each boardlock 16 comprises a pair of biased legs 162 downwardly extending beyond a bottom face 124 of the housing 12 for being interferingly inserted into a second hole 34 defined in the board 30. The legs 162 of each boardlock 16 each form a barb 164 tapered toward a tip end thereof and engagable with the board 30. A s tabilizer bar 18 is further formed at a middle portion of the same lateral side 122 on which the boardlocks 16 are located. The stabilizer bar 18 comprises a slanted top surface 184 and a horizontal bottom surface 182 generally co-planar with the bottom face 124 of the housing 12 for abutting against a top surface 36 of the board 30.

In assembly, the pin header 10 is mounted onto the board 30. The legs 162 of the boardlocks 16 are deflected inward, allowing insertion of the legs 162 into corresponding second holes 34 of the board 30. The legs 162 rebound outward following successful insertion. Thus, the barbs 164 of the boardlocks 16 abut against a bottom surface 38 of the board 30, thereby locking the pin header 10 to the board 30 and preventing the housing 12 from rocking toward a second lateral side 123 of the housing 12 opposite the lateral side 122. The bottom surface 182 of the stabilizer bar 18 abuts against the top surface 36 of the board 30, thereby preventing the housing 12 from rocking toward the lateral side 122. Thus, during soldering or mating, the tendency of the terminal pins 14 to float or of the housing 12 to rock towards a lateral side is limited by the stabilizer bar 18 and the boardlocks 16. Therefore, the terminal pins 14 of the present invention can be more securely and reliably soldering into the first holes 32 of the printed circuit board 30 than terminals of the prior art connectors can.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A header connector for mounting onto a printed circuit board, comprising:

a dielectric housing having formed on and extending outwardly from a lateral side thereof at least a boardlock and a stabilizer bar, the boardlock for being interferingly engaged with the printed circuit board and the boardlock and the stabilizer bar together for preventing the housing from floating or rocking during soldering or mating; and a single row of terminal pins being retained in the housing, each terminal pin comprising a contact portion adapted for contacting a contact of a complementary connector, and a tail portion adapted for soldering into a first hole defined in the printed circuit board;

wherein each boardlock forms a pair of biased legs for being interferingly inserted into a second hole defined in the printed circuit board;

wherein each leg of the boardlock forms a barb tapered toward a tip end thereof for abutting against a bottom surface of the printed circuit board for preventing the housing from floating during soldering or rocking toward a second lateral side of the housing opposite the lateral side;

wherein the stabilizer bar is located at a middle of the lateral side of the housing;

wherein the stabilizer bar forms a horizontal bottom surface, said bottom surface being coplanar with a bottom face of the housing, for abutting a top surface of the printed circuit board for preventing the housing from leaning toward the lateral side of the housing.

2. A header assembly, comprising:

a printed circuit board defining a plurality of first holes and at least one second hole therein, and having a top surface; and a header connector being mounted on the printed circuit board, said header connector having a dielectric housing and a single row of terminal pins retained in the housing, each terminal pin having a contact portion adapted for contacting with a terminal of a mating connector, and a tail portion for soldering into a corresponding first hole of the printed circuit board, said housing having formed on and extending outwardly from a lateral side thereof at least a boardlock latching into the at least one second hole and a stabilizer bar abutting the top surface of the printed circuit board;

wherein the at least one second hole comprises a pair of second holes and the at least one boardlock comprises a pair of boardlocks and each boardlock forms a pair of biased legs interferingly inserted into the corresponding second hole of the printed circuit board;

wherein each of the legs of each boardlock forms a barb tapered toward a tip end thereof for abutting against a bottom surface of the printed circuit board;

wherein the stabilizer bar is located at a middle of the lateral side of the housing and between the pair of boardlocks;

wherein the stabilizer bar forms a horizontal bottom surface coplanar with a bottom face of the housing and abutting the top surface of the printed circuit board.

* * * * *